US005607201A

United States Patent [19]

Irie et al.

[11] Patent Number: 5,607,201

[45] Date of Patent: Mar. 4, 1997

[54] VEHICLE SEAT HAVING AN OVERLAYER UNBOUND TO AN UNDERLAYER THAT IS BOUND TO A SEAT PAD

[75] Inventors: Hideki Irie; Kazuo Hatakeyama, both of Ayase, Japan

[73] Assignee: Ikeda Bussan Co., Ltd., Ayase, Japan

[21] Appl. No.: 334,485

[22] Filed: Nov. 4, 1994

[30] Foreign Application Priority Data

Nov. 8, 1993 [JP] Japan ..... 5-300769

[51] Int. Cl.[6] ..... A47C 7/02

[52] U.S. Cl. ..... 297/452.62; 297/DIG. 1

[58] Field of Search ..... 297/452.58, 452.61, 297/452.62, 218.2, DIG. 1

[56] References Cited

U.S. PATENT DOCUMENTS 4,747,638 5/1988 Saito ..... 297/452.62

5,016,941 5/1991 Yokota ..... 297/452.61

*Primary Examiner*—Milton Nelson, Jr.

*Attorney, Agent, or Firm*—Foley & Lardner

[57] ABSTRACT

A vehicle seat includes an outer skin layer, which covers the seat cushion or seat back. The seat cushion or seat back is integrally formed with a fastener disposed on a main surface portion thereof. The main surface portion has an underlayer disposed under an overlayer, which includes an outerskin surface, freely disposed over the underlayer. The overlayer and the underlayer are joined only along common edge portions thereof while the surface areas thereof are not attached. The lower side of the second underlayer is affixed to the fastener disposed on the seat cushion or seat back. Each of the skin layer and the overlayer and underlayer may be of two or three ply construction including a backing material and a wadding layer. This construction allows high assembly efficiency with a reduced number of parts. Further, disassembly of seat components for recycling is also simplified while enhanced appearance of the installed seat cover is easily accomplished.

7 Claims, 4 Drawing Sheets

VEHICLE SEAT HAVING AN OVERLAYER UNBOUND TO AN UNDERLAYER THAT IS BOUND TO A SEAT PAD

BACKGROUND OF THE INVENTION

1. Field of The Invention

The present invention relates generally to a seat, particularly to a passenger or driver seat for an automotive or other type of vehicle.

2. Description of the Related Art

The basic construction of a seat for an automotive vehicle according to the current art will be explained hereinbelow with reference to FIGS. 6 and 7.

A may be seen, such a conventional seat 1 comprises a seat cushion la and a seat back 1*b* mounted on a substantially inverted U-shaped seat frame 2. A pad 3 may be spring mounted on a front and upper side of the frame 2 and a seat cover 5 is disposed over the pad 3. The seat cover 5 is comprised of an upper skin layer 5*a*, which may be formed of synthetic resin, leather etc., under which a wadding layer 5*b* is disposed. Under the wadding layer 5*b*, a backing material layer 5*c* is provided.

The seat cover 5 must have each portion thereof joined at the edges, for the desired seat contours of a main surface portion (i.e. the portion that most contacts the body of the seat occupant) the edges must be retained with slit wire, and S-shaped springs (not shown) are clipped to the seat frame or other member. Thus a number of parts and complexity of assembly are increased.

FIG. 7 shows a top cross-sectional view of the conventional seat wherein it may be seen that the lower layer, that is the backing material layer 5*c*, is affixed to the seat pad 3 via the fastener 7.

According to this construction however, the contoured portions of the cover 5 are limited in position according to the S-shaped frame and the edge portions thereof must be retained by wires. Thus assembly becomes difficult and a large number of parts raise the coast and complexity of forming the vehicle seat 1. Further, no freedom of movement of the main surface portion is available. The restriction of the main surface portion of the cover 5, by wires and the like, can cause puckering, or floating of other portions of the cover 5, degrading the appearance of the finished upholstery when installed on the seat.

Further, according to such seat assembly, dismantling of vehicle seats for recycling or the like is complicated since pliers or other tools need to be utilized for cutting clips, wires, etc., and the various layers of the cover 5 are bonded together such that separation of the various materials is difficult.

Thus it has been required to provide a vehicle seat in which a desired appearance and utility may be economically achieved with a low number of parts and quick efficient assembly and disassembly.

SUMMARY OF THE INVENTION

It is therefore a principal object of the present invention to overcome the drawbacks of the related art.

It is a further object of the present invention to provide a vehicle seat in which a desired appearance and utility may be economically achieved with a low number of parts and quick efficient assembly and disassembly.

In order to accomplish the aforementioned and other objects, a vehicle seat is provided, comprising: a seat pad formed on a synthetic resin foam, a main surface portion of the seat pad being formed with an integral fastener; a seat cover disposed over the seat pad; a first underlayer of the seat cover disposed directly over the main surface of the seat pad, a lower side of the first underlayer being attached to the fastener, the first underlayer comprising at least a layer of backing material; a second overlayer of the seat cover disposed freely atop the first underlayer, the second overlayer including at least an outer skin surface; the seat cover, the first and second layers being attached only at edge portions thereof defining the main surface, the surface areas of the first and second layers being freely displaceable in relation to each other.

DESCRIPTION OF THE PREFERRED EMBODIMENT

Figure 1:
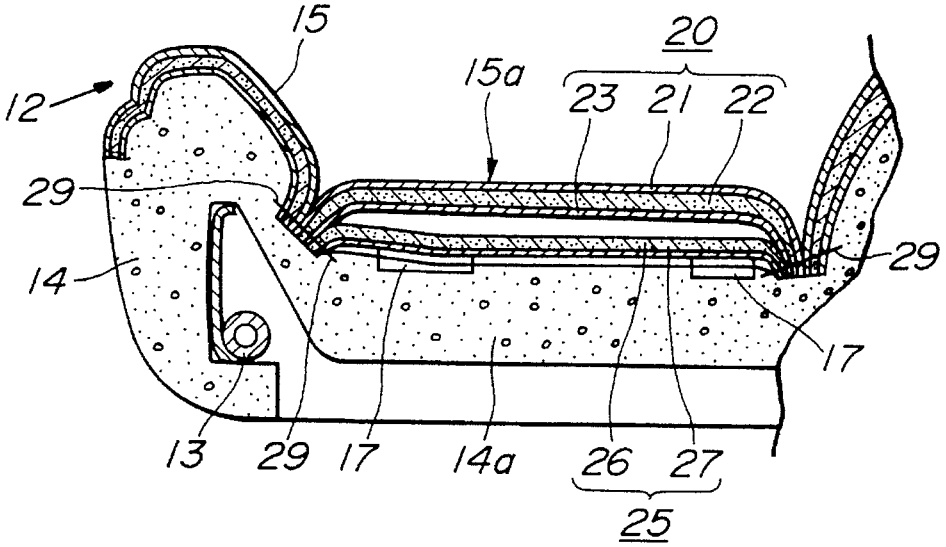
FIG. 1 is a cross-sectional top view taken along line 1—1 of FIG. 2 of a main surface portion of a vehicle seat according to a first preferred embodiment of the invention.
Figure 2:
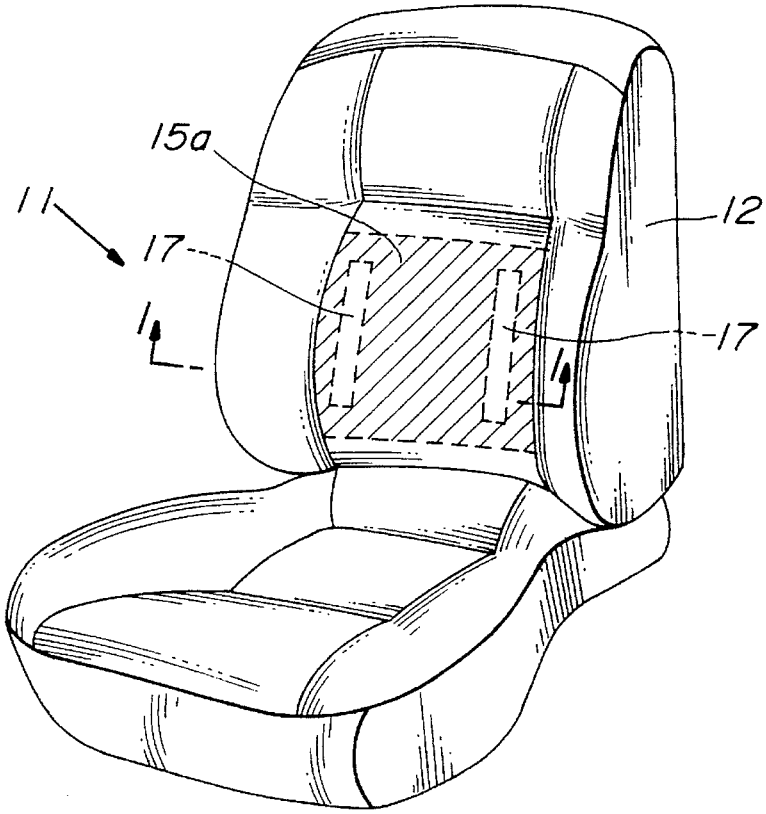
FIG. 2 shows a perspective view of the vehicle seat according to first embodiment.

Referring now to the drawings, particularly to FIGS. 1 and 2, a first preferred embodiment according to the invention will be described in detail.

Referring to FIG. 1, a first embodiment of a vehicle seat 11 according to the invention is drawn to a seat back 12 although the present invention may also be applied to a seat cushion, headrest, etc. The seat 11 comprises an inverted U-shaped seat frame 13 having a plurality of S-shaped spring members (not shown) spaced therealong. A seat pad 14 is disposed on the seat frame 13, retained by the spring members (not shown), a seat cover 15 is disposed over the seat pad 14.

Further, the lower side of the pad 14 may be provided with a supporter of heavy cloth (not shown) or the like and a main surface portion 14*a* of the pad 14 is provided with a pair of fasteners 17, 17 integrally formed therewith.

According to the present embodiment, a pair of vertically disposed fasteners 17, 17 are provided on each side of the main surface portion of the seat back. However, according to the invention various types and number of fasteners may suitably be applied.

It will further be noted that the fasteners nay be integrally formed of the same synthetic resin of which the foam pad is formed.

Figure 3:
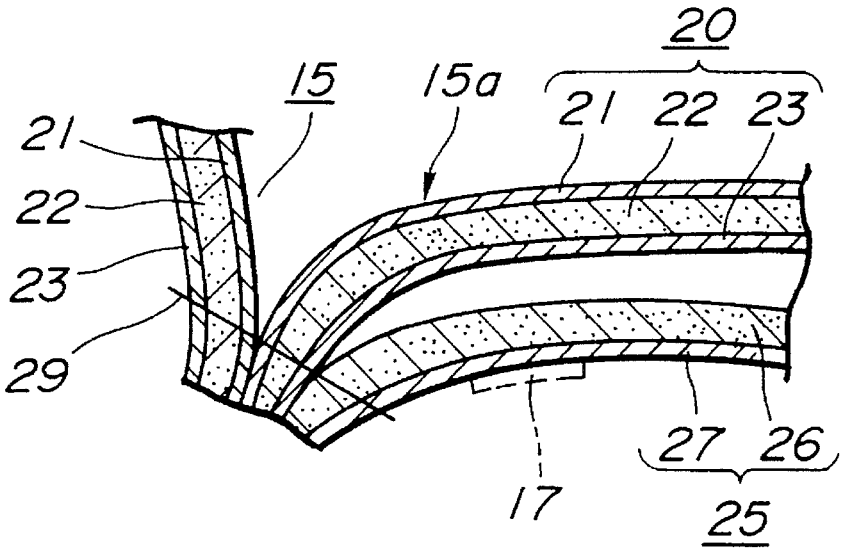
FIG. 3 is an enlarged cross-sectional top view of a main surface of a cover portion of FIG. 1.

Referring now to FIG. 3 which is a cross-sectional view of the seat cover 15, the construction of a main surface portion 15*a* is shown in detail. As may be seen, according to tile present embodiment, a top or first layer 20 of the main surface portion 15*a* is comprised of an outer skin layer 21, an inner wadding layer 22 and a backing material 23 which, is the same constitution as the material of the seat cover 15 overall. In addition, a second layer 25 is provided under the first layer 20. In the present embodiment the second layer includes an upper wadding layer 26 and a backing material 27. A seam 29 joins the first and second layers 20, 25 together and to a secondary surface portion of the seat cover 15 adjacent to the main surface portion 15*a* at the edges of the main surface portion 15*a*. It will be noted that the first layer sits freely atop the second layer and the first and second layers are not bonded or attached on the surface areas thereof at the main surface portion 15*a*. The lower side, that is the backing material 27 of the present embodiment is affixed to the pair of fasteners 17, 17 for stably holding the main surface portion 15*a* in relation to the main surface portion 14*a* of the pad 14.

Figure 4:
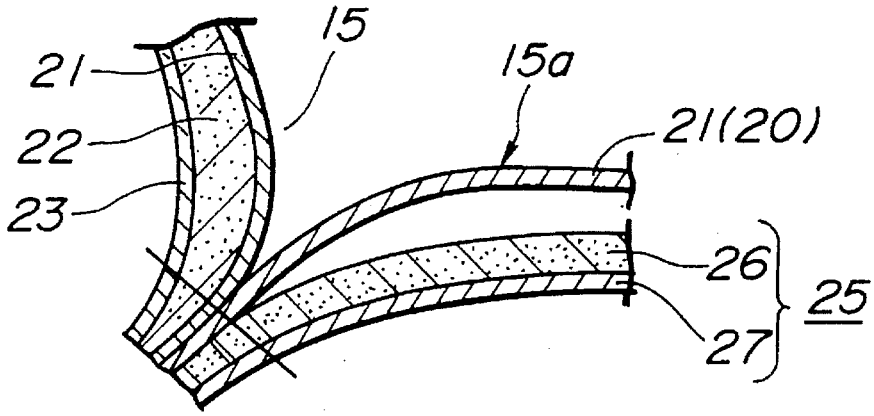
FIG. 4 is a cross-sectional top view similar to FIG. 3 showing a of a second embodiment of the cover portion of the vehicle seat of the invention.
Figure 5:
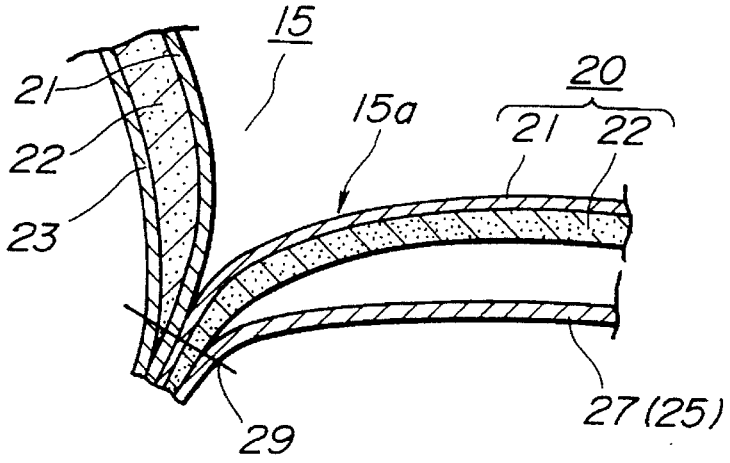
FIG. 5 is a cross-sectional top view similar to FIG. 3 showing a a third embodiment of a cover portion of a vehicle seat.
Figure 6:
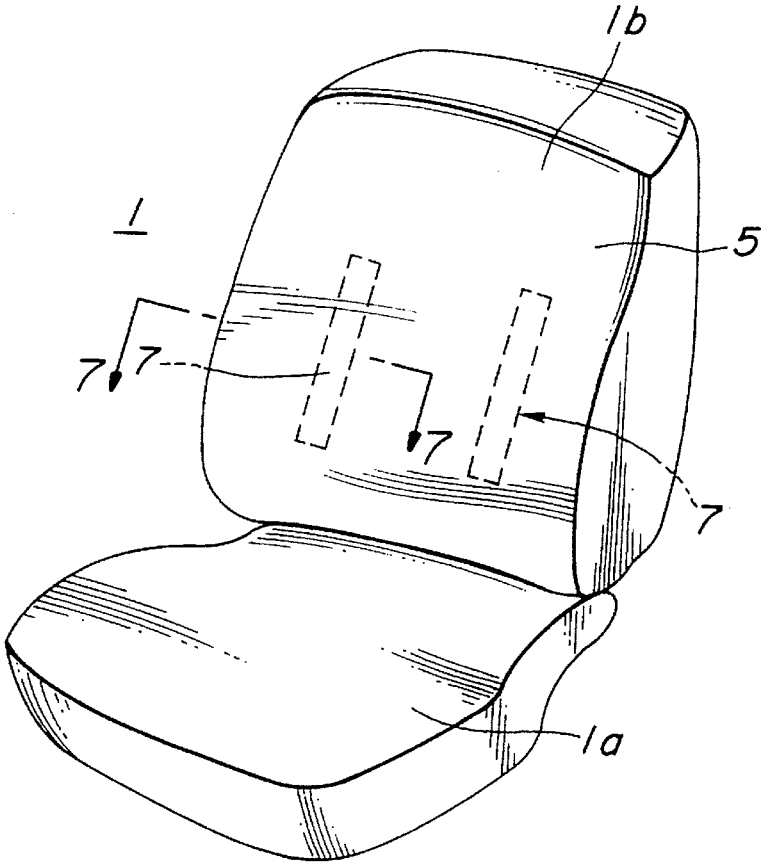
FIG.6 PRIOR ART
FIG. 6 a is perspective view of a vehicle seat of conventional type.
Figure 7:
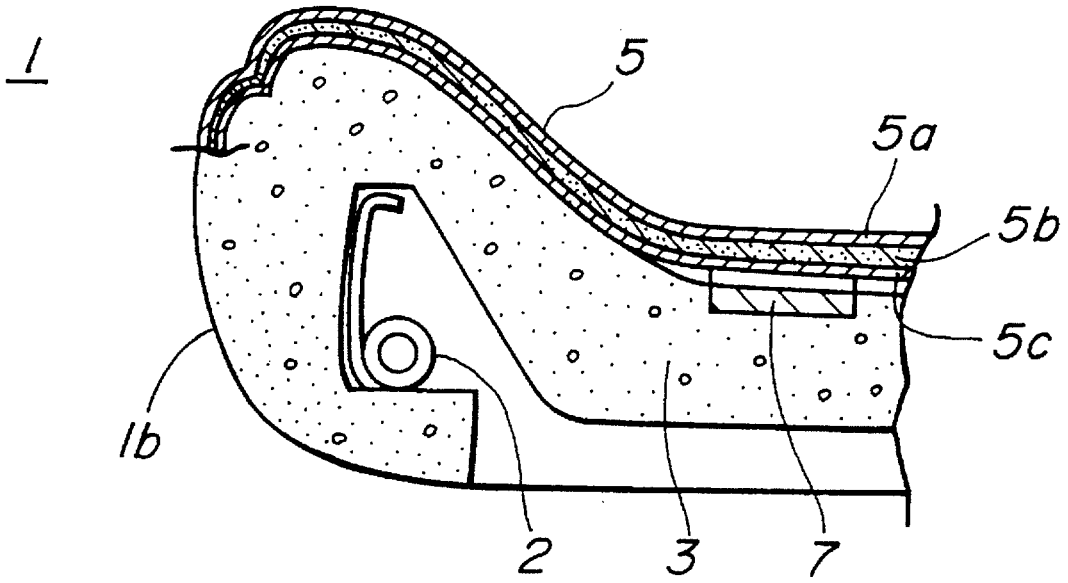
FIG.7 PRIOR ART
FIG. 7 is a cross-sectional top view taken along line 7—7 FIG. 6 of of a main surface portion the conventional vehicle seat.

FIGS. 4 and 5 show alternative constructions of the main surface portion 15*a* of the seat cover 15 according to the invention.

As may be seen in FIG. 4, the first layer is comprised of the outer skin material 21 only, this may be of leather, synthetic resin, or other suitable upholstery material. The second layer 25 of the second embodiment formed of an upper layer of wadding 26 bonded to a backing material 27, the same as in the above-described embodiment. In other respects the seat cover of FIG. 4 is identical to that of the first embodiment. The backing material may be a substantially heavy or coarse fabric or other material of a predetermined strength or weight.

Referring now to FIG. 5, a third embodiment of a main surface portion 15*a* of the seat cover 15 of he invention is shown. According to this modification, the first layer 20 comprises the outer skin layer 21 and a lower wadding layer 22 while the second layer 25 is comprised of the backing material 27 only.

It will be noted that various other arrangements of the first and second layer may also be effected.

According to the above invention, since the shape and size of the main surface portion 15*a* is defined by the seam 29 and only the second layer 25 is attached to the fasteners 17 on the seat pad 14. More flexibility is available in seat design, and the number of parts necessary for defining the main surface portion is reduced. Further, since the surface areas of the layers 20, 25 of the main surface portion 15*a* of the seat cover 15 are not attached, no puckering or degraded appearance of the first layer 20 is caused according to installation of the second layer 25, to the seat pad 14. Thus, optimal appearance is easily obtained with simple installation procedure.

In addition, in disassembly of the seats, during recycling operation, for example, since the layers are kept separate, and are joined only at edge portions as defined by the seam, the components of the seat cover may be easily separated without need of special tools.

As noted above, the above disclosed construction of the main surface portion may be easily applied to either seat cushions or seat backs.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A vehicle seat, comprising:

a seat pad formed of a synthetic resin foam, a main surface portion of the seat pad having at least one integral fastener;

a seat cover disposed over the seat pad, the seat cover including:

an underlayer disposed directly over the main surface portion of the seat pad, a lower side of the underlayer being attached to the fastener, the underlayer comprising at least a layer of backing material; and an overlayer disposed freely atop the underlayer, the overlayer being of three ply construction including an outer skin surface, a central wadding layer, and a lower layer of backing material, wherein the underlayer and the overlayer are attached to one another only at edge portions thereof defining a main surface of the seat cover, the surface areas of the underlayer and overlayer being freely displaceable in relation to each other.

2. A vehicle seat according to claim 1, wherein a remaining seat cover portion and the overlayer have identical construction.

3. A vehicle seat according to claim 1, wherein the underlayer is of two-ply construction, including an upper wadding layer and a lower layer of backing material.

4. A vehicle seat according to claim 1, comprising a pair of fasteners.

5. A vehicle seat according to claim 1, wherein the seat pad is a seat back of an automotive vehicle.

6. A vehicle seat according to claim 1, the seat pad is a seat cushion of an automotive vehicle seat.

7. A vehicle seat according to claim 1, wherein the edge portions are attached by stitching.

* * * * *